United States Patent [19]

Pankratz et al.

[11] 4,111,087

[45] Sep. 5, 1978

[54] CHEESE PACKAGING APPARATUS

[76] Inventors: Richard R. Pankratz; Larry R. Kegg, both of 1230 Wright's La., West Chester, Pa. 19380

[21] Appl. No.: 801,316

[22] Filed: May 27, 1977

[51] Int. Cl.[2] ..... B26D 5/20

[52] U.S. Cl. ..... 83/210; 53/518; 83/408; 83/431; 198/781

[58] Field of Search ..... 83/210, 408, 425.3, 83/431, 651.1; 198/781, 789, 790, 791; 53/123

[56] References Cited

U.S. PATENT DOCUMENTS

| | | | |
|---|---|---|---|
| 3,478,397 | 11/1969 | Pearne et al. | 83/408 X |
| 3,567,010 | 3/1971 | Vom Stein | 198/781 |
| 3,739,668 | 6/1973 | Comstock et al. | 83/102 |
| 3,961,700 | 6/1976 | Fleischauer | 198/781 |

*Primary Examiner*—Travis S. McGehee

*Attorney, Agent, or Firm*—Robert S. Lipton; Arthur E. Oaks

[57] ABSTRACT

A cheese packaging apparatus is provided which includes a cheese cutter which is activated only when a loaf of cheese is properly positioned at an intake position. The cheese cutter may also be adapted so as to only operate when an exit platform, on to which the cut cheese is to be placed, is properly positioned. The cheese cutter includes a vertical harp and is adapted to laterally move a loaf of cheese from a roller conveyor through the vertical harp, thereby cutting the loaf. Rollers having a driven inner portion which cause an outer portion to rotate when the torque between the two portions is below a particular magnitude are included in the conveyor leading to the cutter.

4 Claims, 4 Drawing Figures

CHEESE PACKAGING APPARATUS

BACKGROUND OF THE INVENTION

This invention relates to an apparatus which is used in the packaging of cheese and cheeselike products in general. In particular the invention relates to an apparatus which will accept a loaf of cheese, of a standard size, cut it into smaller portions and pass the cut portions on to the next step in the process. The apparatus will accept the standard loaves when they are placed randomly on a conveyor and will accept a loaf only when it has been automatically and properly positioned for ingestion into the cutting portion of the apparatus.

The apparatus is particularly designed for use in the packaging of "cheese," "processed cheese" and "cheese food." "Processed cheese" generally refers to cheese which is made by grinding and mixing together by heating and stirring one or more natural cheeses. The cheese may be of the same or different varieties. Various acids, emulsifying agents and other additives may be included.

"Cheese food" generally refers to cheese product which is prepared from the same materials as indicated above but may have optional dairy ingredients added, such as cream, milk, skim milk, whey. The moisture level of "cheese food" is generally higher than that of processed cheese and has less fat contained therein.

The apparatus of the present invention is designed to be applicable to "cheese," "processed cheese" and "cheese food" all of which shall hereinafter be referred to as "Cheese."

Cheese has been particularly difficult for automatic handling equipment to accomodate. Cheese is a very soft and structurally weak material. It is a material which sticks or tends to cling to any surface upon which it is placed. Additionally its strength and adhesionary characteristics vary with its temperature and atmospheric conditions. Loaves of cheese are formed at elevated temperatures; the loaves cool as the loaf continues its path through the packaging apparatus thus varying its properties. The foregoing factors account for the great difficulty which has been encountered in manufacturing operable, and consistently operable, cheese handling equipment. Machinery which has successfully handled apparently similar food products, such as yeast, have not performed satisfactorily when used with cheese.

Methods for the manufacture of stacked slices of cheese are well known in the prior art. U.S. Pat. 3,900,574 to Warwick issued Aug. 19, 1975 discloses an apparatus for continuously producing a plurality of ribbons of cheese and for stacking and cutting the ribbons of cheese to form loaves of individual slices of cheese.

The rectangular loaves of cheese are generally cut so as to produce a plurality of stacks of square cheese slices. The stacks of square slices of cheese are then wrapped and sealed in a wrapping generally made of cellophane.

There have been many problems encountered in taking the loaves of cheese, cutting them into stacks of square slices of cheese and passing them on to a wrapping machine.

The transporting of the loaves of cheese from the point where they are cut to the cutting machine where they are reduced to the square stacks has been difficult and has required that the cheese be placed on the conveyor in a predetermined manner. The cheese at this point in the process is at an elevated temperature which causes the loaves to stick or adhere to the transporting conveyor.

Various types of conveyors have been used for this purpose. Some of the conveyors have been of the belt type in which the bottom of the lower layer of cheese is entirely in contact with the belt. This type of configuration has resulted in maximum adherence of the cheese to the belt resulting in the lower layer of cheese being torn due to its low strength when the loaf is laterally transferred from the belt. Additionally, this has created difficulty in removing the loaf from the conveyor. An attempted solution for this problem has been to use a conveyor comprised of stationary but rotatable rollers. It was hoped that since the rollers presented less surface area from coming into contact with the cheese there would be less adhesion however, the roller conveyor still produced a torn lower layer in the cheese loaf.

Machines which cut loaves of cheese take a loaf at an intake position and pass the loaf through a plurality of spaced cutting wires called a harp. The loaf of cheese is forced through the harp by a ram which generally has grooves in it, spaced to be compatible with the wires in the harp. In operation the wires of the harp become positioned in the grooves as the ram forces the cheese through the harp. As the loaf passes through the harp the cheese is cut into the desired segments and is passed to an exit point. Such cutting machines generally have had one operating mode wherein the machine is simply turned on and an arm pushes a loaf through the harp to the exit point where it is passed on to the wrapping machine. If no loaf is present at the intake position the arm is still actuated. Thus, heretofore it has been necessary to time the conveyer taking the cheese to the intake point so that a loaf of cheese is present at the intake point at the desired time. This has resulted in a requirement that the loaves be properly positioned on the conveyor and that the conveyor itself be properly timed to the cutting machine. This has resulted in a slow process wherein no more than 30 loaves per minute could be passed. Additionally, if a loaf of cheese was not present at the desired point at some point downstream in the process a void would be presented to the wrapping machine which would cause additional problems. Conventional wrapping machines malfunction when they are operating and the cheese which is to be wrapped is not present.

Many attempts have been made to solve the problem heretofore described. The solutions to these problems had been thwarted by still additional obstacles. As will hereinafter be described it is desirable that the conveyor be comprised of rollers which are continuously driven but will still permit a particular block of cheese to remain stationary.

Heretofore in apparatus of this type the cutting machines utilized a horizontal harp. The loaf of cheese would be placed upon an elevator and raised so as to pass the loaf through the harp thereby cutting it. This process has caused cheese fragments to be forced between adjacent cheese layers as the loaf is passed through the harp. It has additionally resulted in increasing the propensity of cheese particles to remain adhering to the wires of the harp thus producing imperfect and flawed cuts when subsequent loaves are passed through it. It has long been known that a solution to these problems would be to pass the loaf of cheese through a vertical harp thus permitting the cheese fragments to drop and not be forced between adjacent cheese layers. Additionally when the grooved ram which forces the cheese through the harp is disengaged the cheese fragments which would otherwise remain lying on the ram are permitted to fall free. This obvious solution to the problem has been stymied due to difficulty in moving loaves of cheese laterally without damaging the loaf or the resultant portions into which the loaf is cut.

SUMMARY OF THE INVENTION

The cheese packaging apparatus of the present invention includes a cheese cutter which will only commence operation when a loaf of stacked layers of cheese is properly located at the intake position of the cheese cutter. The cheese cutter is fed standard loaves of cheese by a conveyor comprised of rotatable but translationally stationary rollers. The cutter includes a scalloped ram which laterally moves the cheese across the rollers through a vertical harp on to a platform. In the preferred embodiment of the invention the platform is an elevator, in its lowered position, which forms a portion of an automatic wrapping machine. The scalloped ram has vertical grooves in it which receive the vertical wires of the cutting harp. Engagement and disengagement of the harp wires by the grooves remove any excess cheese particles from the harp.

A skirt or blocking barrier is connected to the ram to prevent other loaves of cheese from traveling along the conveyor until the ram has withdrawn from the harp to its starting position. When the ram resumes its starting position the next loaf of cheese may pass down the conveyor to the intake position of the cutter.

Appropriate sensors and logic circuitry are provided so that the ram will be actuated from its starting position only after the elevator has assumed its lowered position and when a loaf of cheese is properly located in the entry position.

A hinged backstop is provided at the end of the conveyor. When the block of cheese abuts the backstop the proper entry position to the cheese cutter has been attained. The combination of the hinged backstop and the driven rollers of the conveyor have the effect of properly aligning the cheese with respect to the rollers and hence the harp.

As previously mentioned the rollers of the conveyor leading to the cheese cutter are rotatably driven. Each of the rollers includes an inner driven roller which is inserted into the interior of an outer roller. The ability of the inner roller to cause rotation of the outer roller is controlled by a variable clutch included within each roller. The clutch permits the degree of torque which is required in order for slippage to be permitted between the two rollers to be varied.

When the ram of the cheese cutter is extended the preceding loaf of cheese upstream will impact the skirt preventing it from traveling any further along the conveyor. The torque between the inner and outer rollers upon which that particular loaf of cheese is resting will previously have been adjusted so that the outer roller will cease to rotate. If rotation does occur the loaf becomes damaged as rotation of the roller will wear a groove in the lower layer of the loaf. This type of damage will occur even if there is no tendency of the lower loaf to adhere to the rollers.

The outer roller is provided with a Teflon coating or a coating of another suitable non-stick material. This is particularly important as one of the problems which has been associated with using rollers in conveyors for cheese has been that activation of the rollers with cheese thereon from a stationary position has caused the lower layer of the loaf to become damaged due to its tendency to adhere and stick to the rollers. This is an important advantage as experience has shown that in some roller conveyor systems a loaf of cheese will not be damaged as long as it is continuously kept moving on the conveyor, the damage occurring when the conveyor is stopped and then restarted.

The non-stick coating of the outer roller of the conveyor rollers is also important as without this non-stick characteristic the cheese could not be laterally forced from the rollers by the ram without causing damage to the lower layer of the loaf.

Therefore, it is an object of the present invention to provide a cheese packaging apparatus which will cut a standard loaf of cheese when a loaf is properly positioned in an intake position.

It is an object of the present invention to provide a cheese packaging apparatus which will cut a loaf of cheese when the elevator of an automatic wrapping machine is in its lowered position and when a loaf of cheese is properly positioned in an intake position.

It is another object of the present invention to provide a cheese packaging apparatus which will cut a loaf of cheese by passing it through a vertical harp.

It is still another object of the present invention to provide a cheese packaging apparatus which includes means for laterally moving a loaf of cheese from a conveyor made of rollers.

It is still another object of the present invention to provide a cheese packaging apparatus including a conveyor constructed of rollers including an inner driven roller and an outer roller which is driven by the inner roller until a torque differential therebetween of a predetermined amount is obtained.

It is still a further object of the invention to provide a cheese packaging apparatus having a harp which is self-cleaning.

BRIEF DESCRIPTION OF THE DRAWINGS

In the following drawings in which like numerals refer to like parts.

DESCRIPTION OF THE PREFERRED EMBODIMENT

Figure 1:
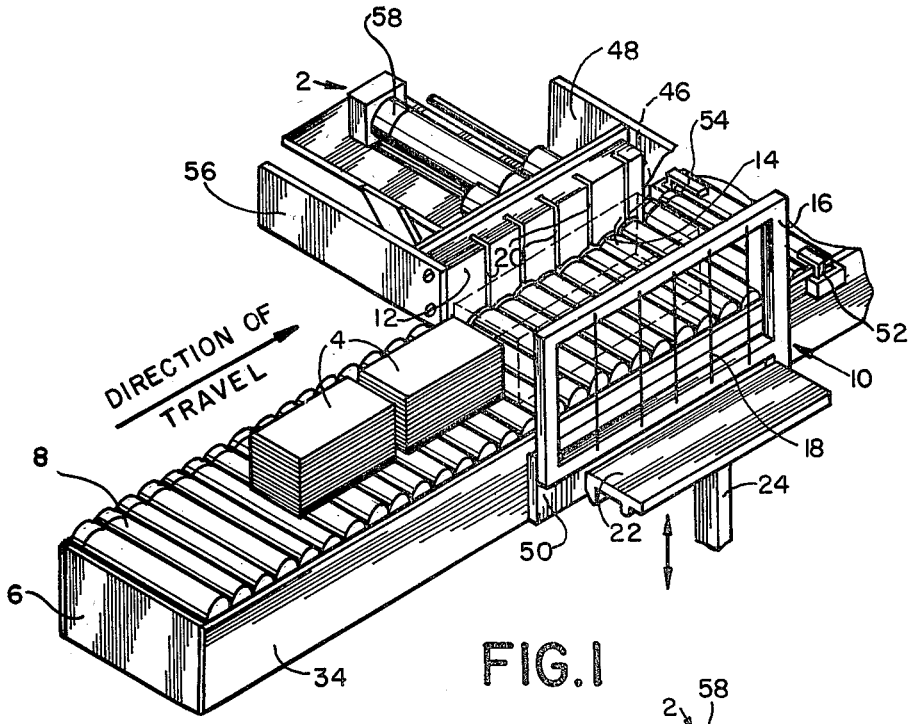
FIG. 1 is a perspective view of the cheese packaging apparatus of the present invention.
Figure 2:
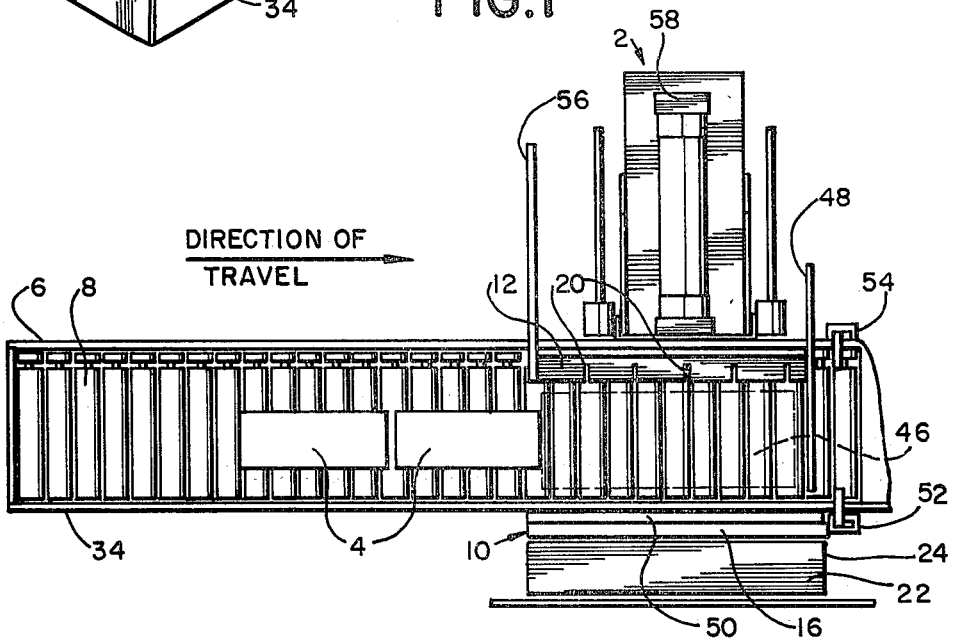
FIG. 2 is a top elevation view of the cheese packaging apparatus shown in FIG. 1.

Referring now to FIG. 1 and FIG. 2 wherein a cheese packaging apparatus 2 of the present invention is shown. Loaves of cheese 4 are shown on a conveyor 6 having rollers 8. The loaves 4 of cheese are formed from strips or layers 5 by machinery not included in the present invention. The loaves may be automatically placed on the conveyor 6 but are generally placed thereon manually.

The conveyor 6 transports the loaves of cheese 4 to the cheese cutter 10. The cheese cutter 10 includes a ram 12 having scallops 14. The ram 12 forces loaves of cheese 4 through a vertical harp 16. The harp 16 includes vertical wires 18 which cut the loaves 4 as it is passed through the harp. As may best be seen in FIGS. 2 and 3 the ram 12 has grooves 20 formed in its vertical surface. The grooves 20 are positioned so as to be compatible with the wires 18. The grooves 20 permit the ram 12 to be extended beyond the vertical plain the harp 16 thus completely forcing the loaf 4 through the harp.

Figure 4:
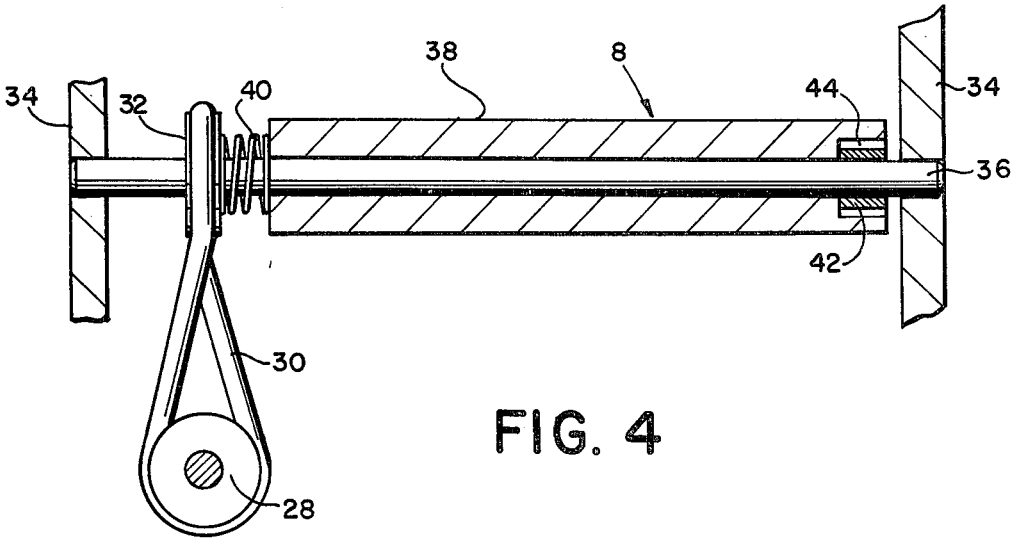
FIG. 4 is a perspective view, partially broken away, showing a partion of the conveyor of the present invention.

As shown in FIG. 2 after a loaf 4 has been forced through the harp 12 it is pushed on to a platform 22. The platform 22 may be simply a surface or it may be a conveyor which would lead the loaf to another position where additional operations may be performed. In the preferred embodiment of the present invention the platform 22 is the horizontal surface of an elevator 24 of a wrapping machine 26. The conveyor 6 is driven by a motor, not shown, which causes a shaft 28 to rotate. Belts 30 are connected to the shaft 28 and to pulleys 32, as shown in FIG. 4.

Each of the rollers 8 which make up the conveyor 6 are supported by a frame 34. Each of the rollers 8 include an inner roller or shaft 36 which is rotatably mounted to the frame at each end by suitable means. The pulley 32 is rigidly secured to the inner roller or shaft 36 so that rotation of the pulley by the belt 30 causes the shaft 36 to rotate. In some cases it may be desirable that a particular roller 8 be driven by a belt connected to an adjacent roller 8 as opposed to the shaft 28. In this instance the pulley 32 of the driving roller 8 would have an additional groove, not shown, to accommodate a second belt.

An outer roller 38 is positioned about, and encompasses, the inner roller or shaft 36. The fit between the shaft 36 and the outer roller 38 is sufficient so as to permit free rotation of outer roller 38 with respect to the shaft 36, unless otherwise restrained. A spring 40 is positioned about the shaft 36 so that it rotates therewith. Rotation of the outer roller is effectuated due to the force which is imparted to the outer roller 38 by the rotation of the spring 40. If the outer roller 38 is restrained from rotating slippage will occur between the spring 40 and the outer roller 38. The magnitude of the force required to prevent rotation of the outer roller 38 is a direct function of the degree to which the spring 40 is compressed. This force may be adjusted by varying the compression of the spring 40. The compression of the spring 40 may be adjusted by laterally changing the position of the outer roller 38 on the shaft 36. This may be accomplished by making appropriate adjustments to a lock nut 42 which abuts a face in a recess 44 in the outer roller 38. Thus, by properly positioning the outer roller 38 along the shaft 36 the magnitude of the torque required to cause slippage may be adjusted. In operation the magnitude of this torque would be adjusted so that, in the event a loaf of cheese is prevented from moving along the conveyor, the outer roller 38 will cease rotating thus preventing damage to the loaf 4. Of course, when the force preventing the loaf 4 from moving is removed the outer roller 38 will commence rotating thus causing the loaf 4 to be appropriately transported.

The outer roller 38 of the roller 8 must be coated with a layer which has excellent release characteristics with respect to the cheese which is being transported. This is necessary so that the bottom layer of the loaf 4 will not drag or tear when the loaf 4 is forced to move laterally along the rollers 8. It has been found that plastic materials such as Teflon, nylon and Delrin have satisfactory release characteristics. In the preferred embodiment of the present invention Delrin is used.

As is shown in FIG. 2 the conveyor transports the loaf of cheese to an intake position 46 of the cheese cutter 10. The intake position 46 is bounded by a hinged backstop 48. The hinged backstop is pivotally connected to a frame 50 of the cheese cutter 10. The hinged backstop 48 properly aligns the cheese in the event the longitudinal axis of the cheese is skewed from its desired right angle position with respect to the longitudinal axis of the rollers 8. A sensor or microswitch 52 is positioned so that when a loaf 4 impacts the hinged backstop 48 the sensor is activated.

The harp 16 is also connected to the frame 50. A hydraulic actuator 58, or any other suitable type of actuator, causes the ram to force a loaf 4 laterally along the rollers 8 of the conveyor 6 through the wires 18 of the harp 16. As the cheese is forced through the harp it is forced on to the platform 22 of the elevator 24. The platform 22 is at a slightly lower level than the upper surface of the rollers 8.

The ram has scallops 14 formed in it to match the contour of the outer rollers 38 of the conveyor 6. The ram is positioned so that it almost comes in contact with the outer roller 38. In this matter maximum contact between the ram 12 and the loaf 4 is achieved. This close tolerance of the gap between the ram 12 and the rollers 8 also minimizes the likelihood that the loaf will be damaged.

Figure 3:
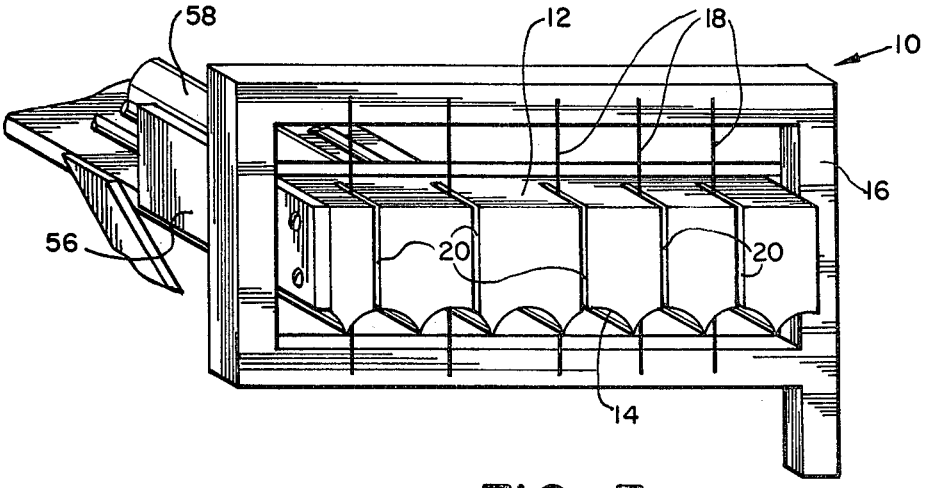
FIG. 3 is a partial perspective view of the present invention showing the ram of the cheese cutter engaging the vertical harp.

The aforesaid structure has resulted in loaves 4 being permitted to be moved laterally across rollers 8. This in turn has permitted the harp 16 to be vertically positioned, which has not heretofore been accomplished. The vertical orientation of the harp 16 results in cheese fragments which would otherwise be forced between the layers of the loaf to fall free. Additionally, as shown in FIG. 3 withdrawal of the ram 12 from the wires 18 of the harp 16 causes said wires to engage the sides of grooves 20, thus having a dislodging effect upon any cheese which has adhered to the wires 18. The vertical orientation of the harp results in these cheese fragments also dropping away whereas heretofore they would have remained located within or about the grooves of the ram. In this manner a self-cleaning feature is effectuated.

When the cut loaf 4 is positioned on the elevator 24 of the wrapping machine 26 it is raised vertically as part of the wrapping operation. A sensor or microswitch 54 senses the return of the elevator 24 to its lower most position. The cheese cutter 10 will not commence operation by activating the ram 12 unless the sensors 52 and 54 indicate that a loaf 4 is properly located at the intake position 46 and that the elevator 24 is in the proper position, respectively. This is accomplished through a logic network, not shown.

When the ram 12 is activated causing it to laterally displace the loaf 4 at the intake position 46 a skirt or arm 56 connected to the ram 12 prevents additional loaves 4 from traveling along the conveyor until the ram 12 has fully withdrawn.

In operation, loaves of cheese 4 are manually or automatically placed on the conveyor 6. In the event any or all of the loaves 4 are prevented from moving along the conveyor slippage occurs between the outer roller 38 which is in contact with the loaf 4 and the driven shaft 36, without damage to the loaf.

When the ram 12 withdraws from a preceding operation the barrier arm 56 is withdrawn permitting another loaf 4 to travel along the conveyor until it impacts the hinged backstop 48 thus causing the loaf 4 to be properly aligned, in the event it had not previously been so, and causing the sensor 52 to be activated indicating that the elevator 24 is in its lower most position to receive additional cut loaves the hydraulic actuator causes the scalloped ram 12 to force the loaf 4 to move along the rollers 8 and through the wires 18 of the vertical harp 16. As the ram forces the cheese through the harp the wires 18 of the harp engage the grooves 20 of the ram. Adn the cut loaf 4 is slidably positioned on the platform 22 of the elevator 24. The elevator 24 is automatically activated removing the cheese to the next operation. Withdrawal of the ram 12 causes the cheese fragments to be dislodged from the grooves 20 and the wires 18 resulting in their falling free from the ram and the wires. Withdrawal of the ram 12 also causes the skirt 56 to be withdrawn thus permitting another loaf 4 to reach the intake position 46.

The present invention has permitted a substantial increase in the rate in which the loaves 4 are handled. Analogous machinery currently available to the prior art can handle up to 30 loaves of cheese per minute. Apparatus manufactured according to the present invention has achieved handling rates of 60 loaves per minute. This has resulted in a substantial increase in the rate in which loaves of cheese may be handled during packaging and has been done while reducing the damage factor.

While the invention has been illustrated and disclosed with reference to a preferred embodiment it is to be understood that various changes and modifications may be made to the invention as disclosed without departing from the spirit of the invention.

What is claimed is:

1. A cheese packaging apparatus for handling loaves of cheese, while maintaining the structural integrity of the loaves which comprises:

conveyor means for transporting the cheese, having a plurality of rotatable driven rollers each having a longitudinal axis upon which loaves of cheese are placed, which are translationally stationary, and wherein said rollers include first means for permitting a loaf of cheese to be stopped from moving along said conveyor if it impacts a barrier while permitting a loaf of cheese not impacting a barrier to be transported;

a cheese cutter adapted to receive loaves of cheese from said conveyor including, an intake position wherein said conveyor provides support for a loaf of cheese when it is located in said intake position, a vertical harp including spaced wires for cutting said loaf, and means for laterally moving said loaf from said rollers in a direction parallel to said longitudinal axis of said rollers through said harp thereby cutting the loaf wherein said laterally moving means includes a hydraulically actuated ram which is perpendicular to, and moves in a direction parallel to the longitudinal axis of said rollers, said ram having a scalloped lower portion so that when said ram is properly positioned the ram extends below the upper surface of said rollers and the bottom of the loaf, said ram being positioned so that a gap between said rollers and said scalloped portion of said ram is of a minimal magnitude, thereby providing maximum surface contact between the side of said loaf and said ram thus minimizing the likelyhood of impairment of the structural integrity of the loaf of cheese; and second means for receiving the loaf of cheese after it has been cut.

2. The apparatus of claim 1 wherein said ram has grooves therein adapted to engage and receive said wires of said harp when said ram is extended thereby forcing a loaf of cheese completely through said harp and dislodging cheese fragments from said harp when said ram is withdrawn.

3. A cheese packaging apparatus for handling loaves of cheese, while maintaining the structural integrity of the loaves, which comprises:

conveyor means for transporting the cheese, having a plurality of rotatable driven rollers, each of said rollers including a longitudinal axis, upon which loaves of cheese are placed, which are translationally stationary, and wherein said rollers include first means for permitting a loaf of cheese to be stopped from moving along said conveyor if it impacts a barrier while permitting a loaf of cheese not impacting a barrier to be transported, and an inner driven shaft which is inserted through an outer roller having a non-stick coating thereon, wherein said outer roller is connected to said shaft by said first means, said first means including a spring, non-rotatably secured to said shaft and slidably engaging said outer roller in a manner which will permit said spring to drive said outer roller when it is rotated by said shaft unless said outer roller encounters resistance to rotation of a predetermined magnitude, and wherein the opposite end of said outer roller from said spring is slidably secured to said rotating shaft by a lock nut whose position may be varied along said shaft thereby permitting the magnitude of said predetermined resistance to be varied by varying the degree to which said spring is compressed by appropriately repositioning said outer roller along said shaft;

a cheese cutter adapted to receive loaves of cheese from said conveyor including, an intake position wherein said conveyor provides support for a loaf cheese when it is located in said intake position, a vertical harp including spaced wires for cutting said loaf, and means for laterally moving said loaf from said rollers in a direction parallel to said longitudinal axis of said rollers through said harp thereby cutting the loaf; and second means for receiving the loaf of cheese after it has been cut.

4. The apparatus of claim 3 wherein said non-stick material is Delrin.

* * * * *